US005205273A

United States Patent [19]

Sparks et al.

[11] Patent Number: 5,205,273

[45] Date of Patent: Apr. 27, 1993

[54] CONVECTION-RADIANT HEATED OVEN

[75] Inventors: Michael W. Sparks; Bob G. Harrell, both of Greenwood, Miss.

[73] Assignee: Viking Range Corporation, Greenwood, Miss.

[21] Appl. No.: 811,998

[22] Filed: Dec. 23, 1991

[51] Int. Cl.[5] ..... A21B 1/00

[52] U.S. Cl. ..... 126/21 A; 126/21 R; 126/273 R

[58] Field of Search ..... 126/21 A, 21 R, 19 R, 126/273 R, 39 C, 22; 432/176, 177; 219/400

[56] References Cited

U.S. PATENT DOCUMENTS

| | | | |
|---|---|---|---|
| 3,463,138 | 8/1969 | Lotter et al. | 126/21 A |
| 3,973,551 | 8/1976 | Caselani et al. | 126/21 A |
| 4,430,989 | 2/1984 | Narang et al. | 126/21 A |
| 4,516,012 | 5/1985 | Smith | 126/21 A |

FOREIGN PATENT DOCUMENTS

| | | | |
|---|---|---|---|
| 62231 | 10/1982 | European Pat. Off. | 126/22 |
| 2721546 | 12/1977 | Fed. Rep. of Germany | 126/21 A |
| 3304059 | 8/1984 | Fed. Rep. of Germany | 126/21 A |
| 49633 | 4/1980 | Japan | 126/21 A |
| 52135 | 3/1984 | Japan | 126/21 A |

*Primary Examiner*—James C. Yeung
*Attorney, Agent, or Firm*—Hopkins & Thomas

[57] ABSTRACT

A convection and radiant heated oven has a cooking chamber and an air heating chamber below and spaced from the cooking chamber. Shield means above the heating chamber defines, with the oven bottom, a heat space in which an apertured duct receives heated air from the heating chamber and conducts it to a convection fan where it mixes with air from the cooking chamber and is ducted into the cooking chamber. Heated air is also passed upward from the heat space directly into the cooking chamber.

13 Claims, 4 Drawing Sheets

CONVECTION-RADIANT HEATED OVEN

FIELD OF THE INVENTION

This invention relates to ovens utilizing forced convection heating, and, more particularly, to an oven utilizing both radiant heat and an improved convection air flow circulation.

BACKGROUND OF THE INVENTION

In the processing of food within an oven, it has long been the most important desideratum that there be a uniform distribution of heated air within the oven to insure uniform heating or cooking of the food. Because an oven contains a relatively large volume of air, it has proven to be quite difficult to minimize temperature gradients and hot spots within the oven, and, consequently, to avoid the uneven application of heat to the food. There have been numerous attempts at such minimization of uneven cooking through oven designs wherein forced convection heating is utilized in an effort to attain temperature uniformity. These ovens have, in general, a heat source, such as a gas or electric burner, and a blower which draws air to be heated across the heat source to heat it and discharges the air thus heated into the cooking chamber.

In U.S. Pat. No. 4,928,663 of Nevin et al there is shown a forced convection oven wherein air heated in a combustion chamber is directed into a blower assembly, which also receives air from the oven chamber which is mixed with the heated air, and the mixture is forced out into the oven chamber. Thus, the blower assembly mixes currents or streams of air, one of which is introduced into the blower assembly from the front and the other of which is introduced through the rear, and centrifugally discharges the uniform temperature mixture into the oven chamber. This is in contrast to the more common arrangement where the two streams are mixed in the oven compartment where the food is located.

In U.S. Pat. No. 5,016,606 of Himmel et al. the air is heated by a burner externally of the oven and delivered to a blower by means of a fire tube. The blower mixes the air so delivered with return air from the oven chamber and discharges the mixture into the oven chamber. In U.S. Pat. No. 4,071,738 of Jenn et al, the air is heated after it is blown into the oven chamber, thus the oven of this patent utilizes both radiant heating and convection heating, inasmuch as the burners or heaters are within the oven chamber, however, the use of heating units within the cooking chamber, as shown by Jenn et al. limits such use to electrical heating elements.

Another type of convection heating oven utilizes jets of heated air applied to the food being cooked. Such ovens are shown in U.S. Pat. Nos. 4,474,498 of Smith and 4,626,661 of Henke, while U.S. Pat. No. 4,817,509 of Erickson discloses an arrangement where heated air is swirled over the food, which is placed in close proximity to the blower. Another arrangement utilizing a swirling action is shown in U.S. Pat. No. 4,865,864 of Rijswijck. In some instances, the nature of the food being cooked, such as certain types of bread, for example, is such that jets of air or swirling air can adversely affect or disturb the food. Thus, it is desirable, in most cases, that there be a general circulation of uniform temperature air which does not disturb the food. The aforementioned Nevin et al patent is directed to such a heating arrangement.

In all of the foregoing, with the exception of the Jenn et al patent, radiant heating is not utilized, or it is not a serious factor in the cooking process. Thus, even though the prior art patents are aimed, in most cases, at achieving uniformity of temperature throughout the volume of the oven, they do not utilize radiant heating to supplement the convection heating with a consequent economy of operation of the oven. In addition, prior art arrangements utilizing forced convection heating, in general, apply the heated air directly to the blower from the rear, thus all of the heated air is under forced convection. Such ovens require somewhat elaborate ducting to distribute the heated air more or less evenly and to return the air to the burner or heater.

SUMMARY OF THE INVENTION

The present invention is directed to the achievement of substantially uniform heating within an oven through the combined use of both radiant and convection heating.

In an illustrative embodiment thereof the oven of the invention comprises a burner box or heating chamber utilizing gas flame heaters. Air to be heated is vented into the burner box through a louvered oven front or kick plate and is passed directly over the flames. Flame spreaders located over the individual elongated burners spread the flames across the underside of an oven bottom shield which, in turn, heats the oven or cooking chamber bottom, thereby supplying radiant heat to the food within the oven. At the same time, the flame spreaders act in the manner of baffles to direct the heated air to an apertured bottom shield duct which extends horizontally from the front toward the rear of the oven. The flame spreaders, acting as baffles, also direct heated air toward vertical recesses extending up the side walls within the oven chamber so that heated convection air passes from the bottom toward the top of the oven chamber, and is drawn into the chamber by the action of a convection fan mounted at the rear of the oven chamber which creates a low pressure region and a high pressure region. This slow convection is in contrast to the conventional forced air convection heating, where the heated air is blown out into the cooking chamber by the convection of air.

The heated air in the bottom shield duct is drawn into a vertical convection duct to an opening in front of the convection fan, which is, in this embodiment, the low pressure side of the fan. The convection duct has, immediately in front of the convection fan, a plurality of apertures arranged in an approximately circular array through which air within the oven chamber is drawn and is mixed with the heated air in the convection duct. A convection fan cover forms first and second laterally extending air ducts through which the air mixture is passed back into the oven chamber from the high pressure side of the convection fan. Because ambient air is continually being drawn into the heating chamber or burner box, used or stale air is vented to the outside through exhaust ducts and vents located at the top front of the oven assembly.

The oven of the present assembly, as described in the foregoing, utilizes, in effect, three heating modes to achieve a high degree of temperature uniformity throughout the oven volume. In addition to the forced convection heating in which the fan blows the air mixture into the cooking chamber, the oven utilizes radiant heating and a relatively slow convection heating from heated air passing up the recesses in the side walls, all of which function to achieve cooking of food at reduced times and temperatures, with a consequent reduction in the tendency of the food to dry out, and with a concomitant economy of operation.

The numerous features and advantages of the present invention will be more readily apparent from the following detailed description, read in conjunction with the accompanying drawings.

DETAILED DESCRIPTION

Figure 1:
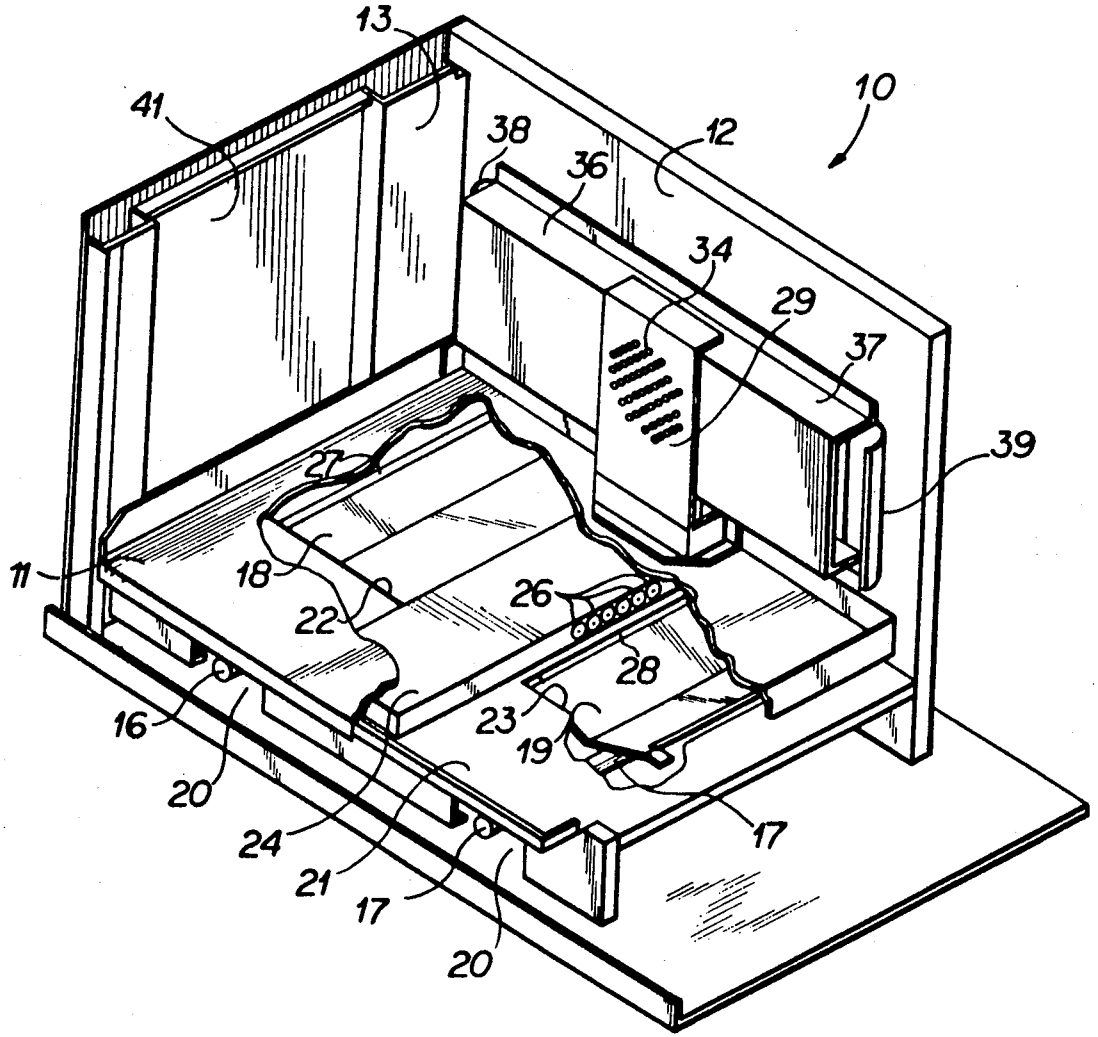
FIG. 1 is a perspective, partially cutaway view of an oven embodying the principles of the invention.

In FIG. 1 there is shown a preferred embodiment of the oven 10 of the invention in a partially cutaway perspective view, wherein the same numerals designate like parts throughout the several drawings.

Oven 10 comprises an oven bottom or floor 11, a rear wall 12, and side walls 13 and 14, only side wall 13 being shown in FIG. 1. Floor 11 and walls 12, 13 and 14 define an oven cooking chamber along with front and top walls, not shown. First and second burners 16 and 17 are located below oven bottom 11 and are spaced therefrom being contained in a burner box 20. Burners 16 and 17, which extend from the front of the oven toward the rear wall 12 are preferably gas burners, however, they may, alternatively, be electric elements. First and second shallow V-shaped flame spreaders 18 and 19 are located over burners 16 and 17, respectively, and function to spread the burner flames over a wide area below the oven bottom 11. An oven bottom shield 21 is located above burners 16 and 17 and below and spaced from the oven bottom 11 forming a heat space 25. In use, the heated air in space 25 heats oven bottom 11 to supply radiant heat to the cooking chamber. Shield 21 has openings 22 and 23 in which flame spreaders 18 and 19 are respectively located and acts, in conjunction with flame spreaders 18 and 19 to protect oven bottom 11 from direct contact with the flames from burners 16 and 17.

Figure 2:
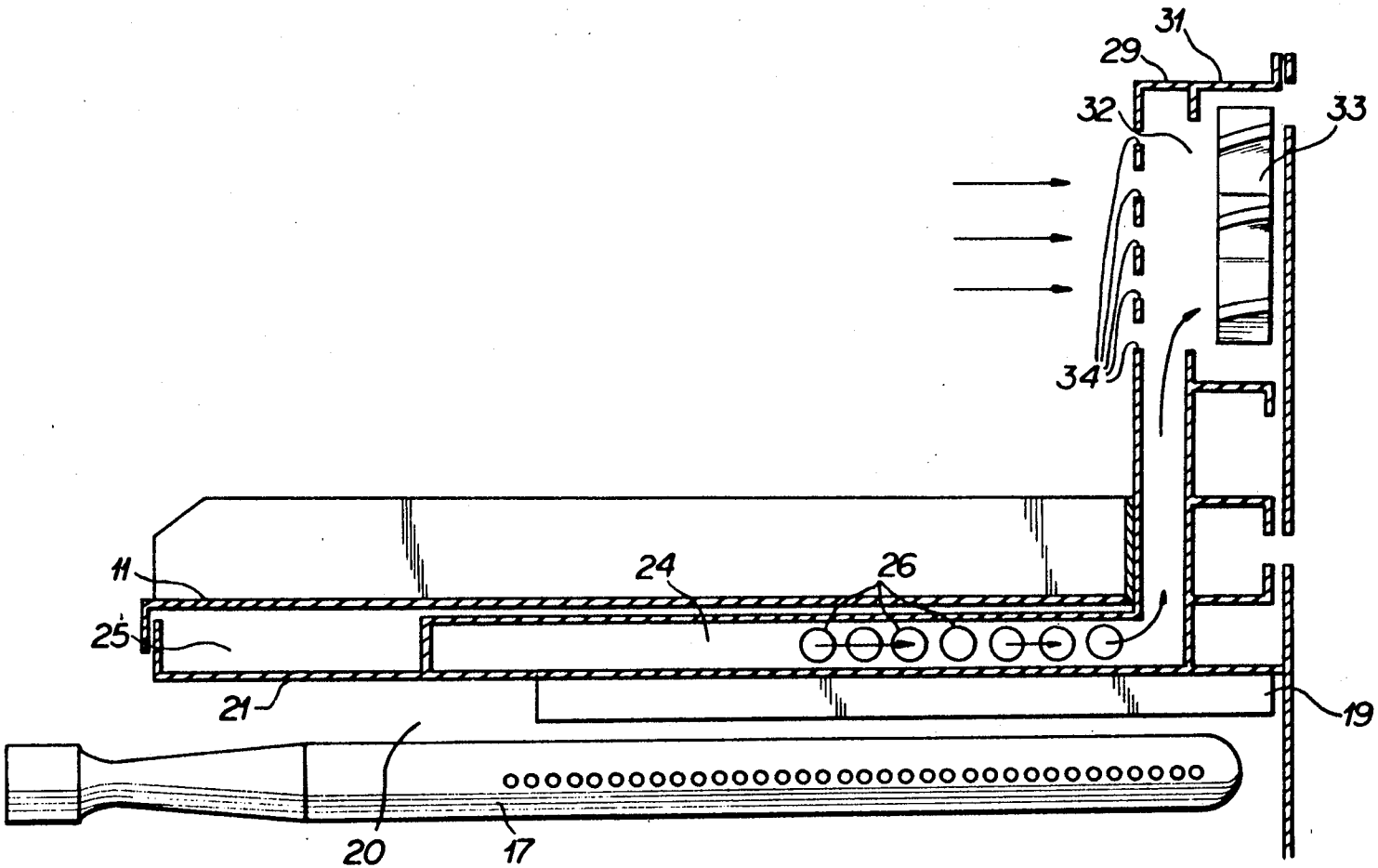
FIG. 2 is a diagrammatic view of a portion of the oven of FIG. 1.

Located in the space 25 between the oven bottom 11 and oven bottom shield 21 is a bottom shield duct 24 preferably of a hollow rectangular configuration which extends from the front area of the oven toward the rear. Duct 24 has a plurality of inlet vent holes 26, 26 on either side thereof. As can be seen in FIG. 1, the width of flame spreaders 18 and 19 is slightly less than their respective openings 22 and 23, leaving four gaps, only two of which 27 and 28 are shown, between the flame spreaders 18 and 19 and the oven bottom shield 21. The gaps serve to permit heated air to pass from below the oven bottom shield 21 into the space between it and oven bottom 11. The heated air thus passing through gap 28, for example, enters duct 24 through the vent holes 26, 26, and, as will be apparent hereinafter, passes through duct 24 toward the rear of the oven. Located at the rear of the interior of the oven 10 is a convection duct 29 of hollow rectangular shape which extends upward from the bottom of the furnace and is in unobstructed communication with duct 24, as best seen in FIG. 2. Referring to FIG. 2, it can be seen that duct 29 extends upwardly in front of a convection fan housing 31 having an opening 32 therein for air flow communication between duct 29 and housing 31. A convection fan 33 is located within housing 31 and serves, when operating, to establish a low pressure region at opening 32. Thus an air flow is created which draws air from the heating region 20 through gap 28 and corresponding gaps into duct 24 through openings 26, 26 and then upward through duct 29. The front of duct 29 has a plurality of intake vent holes 34, 34 through which air passes from the oven chamber into duct 29, through opening 32, and into housing 31.

The pitch of the blades of fan 33 and the direction of rotation are such that a high pressure region is created at the outer ends of the fan blades and also behind the fan and air drawn through opening 32 is directed out of housing 31 through laterally extending ducts 36 and 37, and, with the aid of deflectors 38 and 39 is directed back into the cooking chamber of oven 10. Thus, the ducts 24, 29, fan 33, and ducts 36 and 37 create a forced convection system for the oven whereby air heated by the burners 16 and 17 is mixed with air from the oven and blown into the oven adjacent the side walls thereof.

In addition to the forced convection heating arrangement, as just described, the oven 10 also utilizes a slow convection heating for achieving, in conjunction with the radiant heating from the oven bottom and the forced convection heating, a substantially uniform temperature throughout the volume of the oven cooking chamber. To this end, side wall 13 has a vertically extending recessed portion 41 which is in communication with the space 25 between oven bottom 11 and oven bottom shield 21 into which heated air passes from gap 27 and rises upwardly and into the cooking chamber as shown by the arrows. A corresponding gap and recess in side wall 14, not shown, also allows heated air to rise within the chamber on the other side of the furnace. Thus, the oven 10 of FIGS. 1 and 2 utilizes radiant heating, forced convection heating, and a relatively slow convection heating by the heated air rising up the recessed portions of the side walls. The ratio of the convection heating to radiant heating can be varied by variations in the parameters of fan pitch and speed of rotation, the burner temperature, and, to some extent, the amount of air drawn into and discharged from the oven. In practice, a ratio of sixty percent (60%) radiant heating to forty percent (40%) convection heating has yielded excellent results in achieving uniformity of heating.

Figure 3:
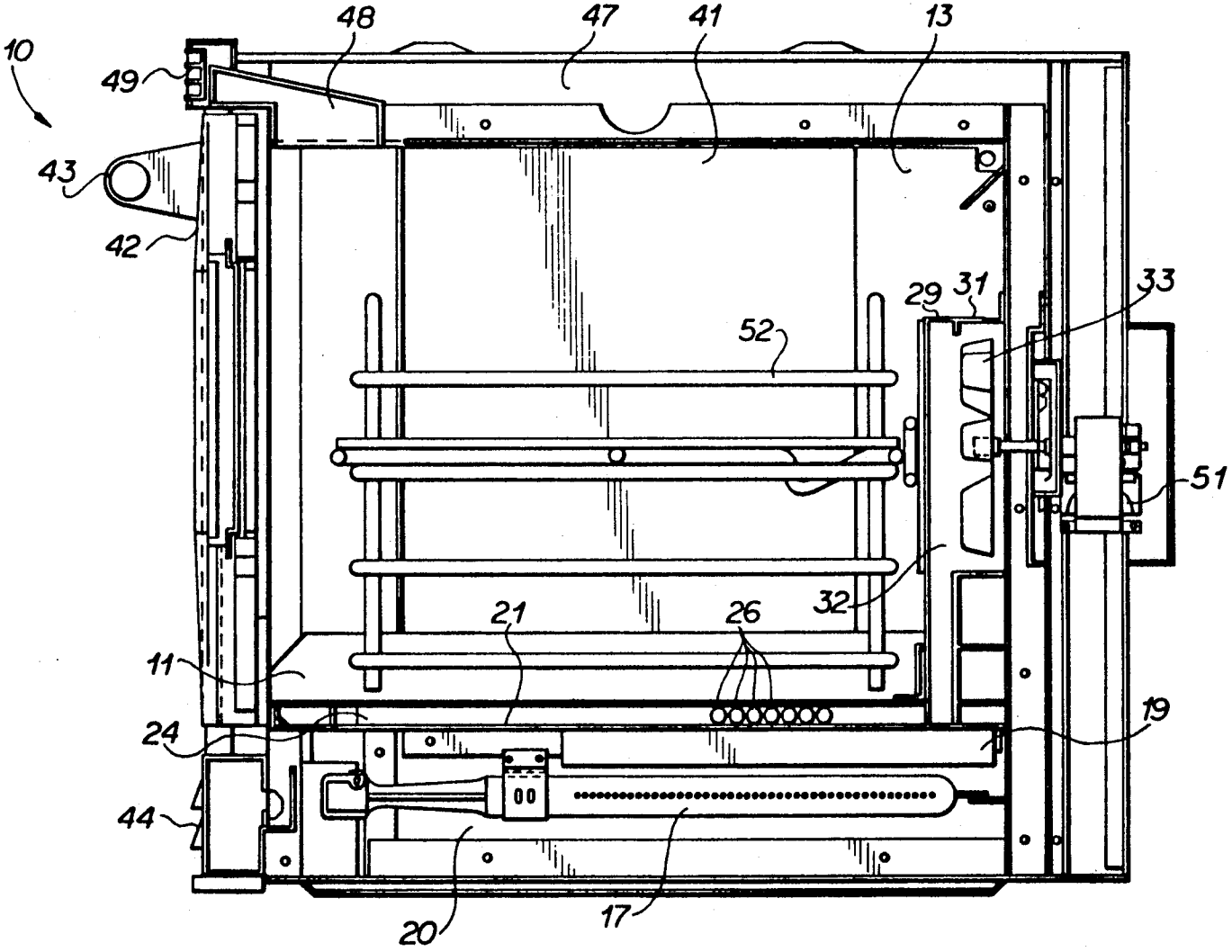
FIG. 3 is a detailed side elevational cross sectional view of an oven embodying the principles of the invention.

FIG. 3 is a detailed side elevation view of an oven cross-section wherein the oven 10 has a conventional hinged door assembly 42 forming an oven front wall and having a pull handle 43. Located below the door assembly 42 is a louvered kick plate 44 through which ambient air is drawn into the oven and into space 20 containing the burners 16 and 17, only 17 being shown in FIG. 3. If desired, air filter means, not shown, may be placed in the space immediately behind kick plate 44 to remove impurities that may be in the incoming air. As was pointed out hereinbefore, fan 33 creates a negative or reduced pressure region which, through ducts 29 and 24, in communication with the air heating region, i.e., burner box 20, thereby insuring a continuous incoming stream of ambient air when the oven is in operation.

Top member 47 of oven 10 has an exhaust duct 48 located therein which communicates with the oven cooking chamber and with the exterior through a vent trim 49 which may be adjusted to control the volume of exhaust air being vented from the oven to the exterior.

Fan 33 is driven by a motor 51, and, as pointed out hereinbefore, the pitch of the blades of fan 33 and the speed of rotation thereof as governed by motor 51 produce a low pressure region at the opening 32. The speed of rotation of motor 51 and the pitch of the blades of fan 33 are two of the parameters that can be varied to produce the desired uniformity of heating within the cooking chamber through variation of the convection currents. The cooking chamber contains a food holding or supporting rack 52 for supporting the food to be cooked.

Figure 4:
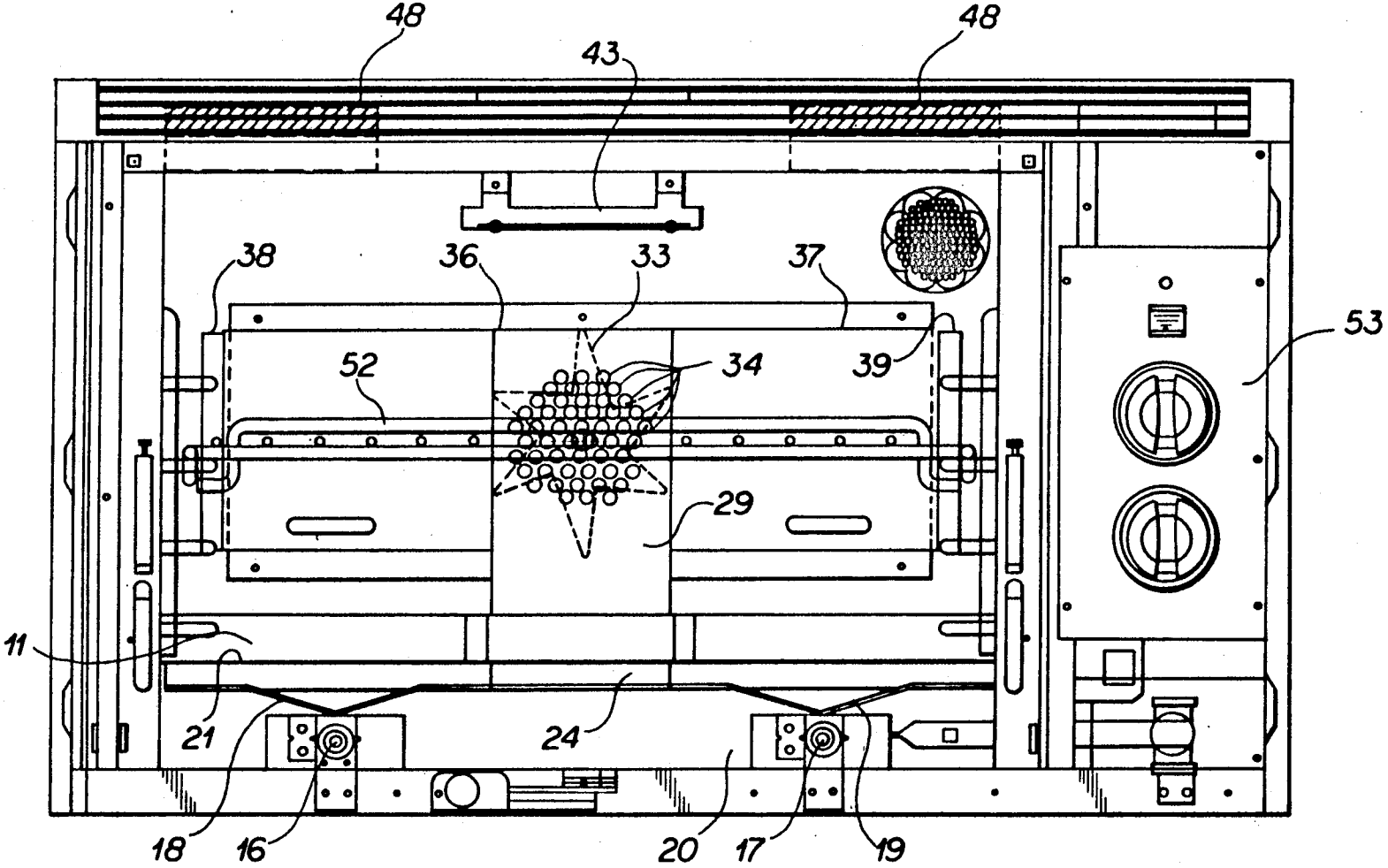
FIG. 4 is a front elevational view of the oven of FIG. 3.

FIG. 4 is a detailed front elevational view of the oven 10 of FIG. 3, showing the relative locations and spacings of the various parts, as well as their general configuration. In addition, FIG. 4 shows the location of an oven control panel 53.

In operation, when the oven 10 is turned on and burners 16 and 17 are ignited, and with fan 33 rotating, ambient air is drawn through louvered kick plate 44 into the heating chamber or burner box 20, and then, as previously described, into duct 24 through openings 26, 26 and also up the recesses 41. At the same time, oven bottom 11 is heated, thus providing radiant heat. The heated air in duct 24 passes into duct 29, where it is mixed with air from the cooking chamber passing into duct 29 through openings 34, 34 and the mixture passes through opening 32, and into ducts 36 and 37 from which it is directed forcefully into the cooking chamber of the oven by deflectors 38 and 39. Used or "stale" air is exhausted through duct 48 to the outside. Thus, there is a constant heating of incoming "fresh" air which continuously replaces previously heated and used air. The combination of radiant heating, slow convection up recesses 41 and forced convection through ducts 36 and 37 produces a high degree of uniformity of heating of food supported on rack 52, which, as pointed out hereinbefore, can be optimized by varying one or more of the parameters of air temperature, fan pitch, and fan speed of rotation. Because the three modes of heating produce a substantially uniform heating of the food within the cooking chamber, the cooking time is substantially reduced and, as a consequence, economy of operation of the oven is improved.

The foregoing description has been directed to a single preferred embodiment utilizing the principles of the invention. Numerous variations and modifications may be made by workers skilled in the art without departure from the spirit and scope of the invention.

What is claimed is:

1. An oven for providing substantially uniform heating in a cooking chamber comprising, an oven cooking chamber having a bottom, a rear wall, first and second side walls, a front wall portion having an air inlet and a top wall, means forming a burner box below said bottom, heating means within said burner box, an apertured shield member positioned over said heating means, a duct member positioned between said shield member and said bottom, said duct member extending above said shield member toward said rear wall and having apertures therein, a convection duct positioned at an end of said duct member adjacent said rear wall, said convection duct being in communication with said duct member to permit passage of air from said duct member to said convection duct and extending from said duct member toward said top wall, said convection duct having an upper end remote from said duct member, a fan housing having first and second laterally extending air ducts and positioned adjacent said upper end of said convection duct and in communication therewith to permit passage of air from said convection duct into said fan housing, a convection fan within said fan housing, and at least one baffle means positioned over said heating means for directing heated air from said burner box through the apertures in said shield member toward the apertures in said duct member.

2. An oven as claimed in claim 1 wherein:

said shield member and said bottom form a heat space, and at least one of said side walls has a recessed portion in communication with said heat space and said cooking chamber.

3. An oven as claimed in claim 2 and further comprising means for directing heated air into said recessed portion of said side wall.

4. An oven as claimed in claim 2 wherein both said first and second side walls have recessed portions in communication with said heat space and extending from said heat space toward said top wall.

5. An oven as claimed in claim 1 and further comprising means in said top wall and said front wall portion for exhausting air from said cooking chamber.

6. An oven as claimed in claim 1 wherein said baffle means is positioned substantially within an aperture of said apertured shield member.

7. An oven as claimed in claim 6 wherein said baffle means forms, in conjunction with the edges of the aperture in said shield member, at least one gap for passage of heated air therethrough.

8. An oven as claimed in claim 1 wherein said convection fan is configured to create a relatively low pressure in the region where said fan housing and said convection duct are in communication, and relatively high pressure regions in said laterally extending air ducts.

9. An oven as claimed in claim 1 wherein said laterally extending air ducts have distal ends remote from said convection fan, and deflector members at said distal ends for directing air into said cooking chamber.

10. An oven as claimed in claim 1 and further comprising means for admitting air from said cooking chamber into said low pressure region.

11. An oven, comprising: a bottom wall, a top wall spaced from and opposing said bottom wall; a first side wall joining said top wall and said bottom wall; a second side wall opposing said first side wall; a rear wall joining said top wall and said bottom wall; and a front wall opposing said rear wall for defining therebetween an oven chamber; said first side wall and said second side wall each defining therein an upwardly extending channel; a pair of burners disposed below and spaced from said bottom wall; and air duct positioned between said bottom wall and said burners, said air duct defining therein openings and said air duct being in fluid communication with said oven chamber; and a fan mounted adjacent to said air duct; wherein air is heated by said burner, a portion of said heated air being directed against said bottom wall, a portion of said heated air being forced by said fan into said oven chamber, and a portion of said heated air moving into said oven chamber through said channels.

12. The oven of claim 11, and flame spreaders positioned above said burners.

13. The oven of claim 11, and an ambient air inlet positioned adjacent to said burners.

* * * * *